United States Patent [19]

Sumida

[11] Patent Number: 4,851,878

[45] Date of Patent: Jul. 25, 1989

[54] COPY INFORMATION OUTPUT DEVICE FOR A COPIER

[75] Inventor: Hiroyasu Sumida, Ichikawa, Japan

[73] Assignee: Ricoh Company, Ltd., Tokyo, Japan

[21] Appl. No.: 155,510

[22] Filed: Feb. 12, 1988

[30] Foreign Application Priority Data

Feb. 13, 1987 [JP] Japan ..... 62-29902
Feb. 13, 1987 [JP] Japan ..... 62-29903

[51] Int. Cl.[4] ..... G03G 15/00
[52] U.S. Cl. ..... 355/204; 355/218; 355/210
[58] Field of Search ..... 355/14 C, 14 R, 7, 3 R; 346/153.1, 160

[56] References Cited

U.S. PATENT DOCUMENTS 3,936,180 3/1976 Willard et al. ..... 355/14 R
4,627,707 12/1986 Tani et al. ..... 355/7 X
4,655,580 4/1987 Watanabe et al. ..... 355/7
4,679,927 7/1987 Sogo et al. ..... 355/7

*Primary Examiner*—R. L. Moses
*Attorney, Agent, or Firm*—Oblon, Spivak, McClelland, Maier & Neustadt

[57] ABSTRACT

A copy information output device for a copier for managing a number of modes by use of a RAM (random access memory). A paper sheet on which all the items and all the modes are printed is copied in a given test mode. Modes other than those currently set are smeared out by solid images so that only the current modes may be perceived by eyesight. Alternatively, modes other than current ones may be erased, and the current modes are transferred to a paper to facilitate confirmation.

6 Claims, 10 Drawing Sheets

Fig. 3

| ITEM | CURRENT MODE |
|---|---|
| 1 AUTO CLEAR TIME | ①1min ②3min ③5min ④∞ |
| 2 REGISTER | ①0mm ②-2mm ③-4mm ④2mm ⑤4mm |
| 3 LEAD EDGE BLANK | ①0mm ②1mm ③2mm ④3mm ⑤4mm |
| 4 TONER SUPPLY | ①HIGH ②MEDIUM ③LOW |
| 5 FIXING TEMPERATURE | ①170°C ②180°C ③190°C ④200°C |
| 6 CONT | ①UP-COUNT ②DOWN-COUNT |
| 7 | |
| 8 | |
| 9 | |
| 10 | |

38

| | |
|---|---|
| FULL ERASE DATA | 0 0 0 0 0 0 0 0 0 0 0 0 0 0 0 0 0 0 0 0 0 0 0 0 0 0 0 0 0 0 0 0 |
| PATTERN 1 DATA | 0 0 0 0 0 0 0 0 0 0 0 0 1 1 0 1 1 0 1 1 0 1 1 0 0 0 |
| PATTERN 2 DATA | 0 0 0 0 0 0 0 0 0 1 1 0 0 0 0 1 1 0 1 1 0 1 1 0 0 0 |
| PATTERN 3 DATA | 0 0 0 0 0 0 0 0 1 1 0 1 1 0 0 0 0 1 1 0 1 1 0 0 0 0 |
| PATTERN 4 DATA | 0 0 0 0 0 0 0 0 1 1 0 1 1 0 1 1 0 0 0 0 1 1 0 0 0 0 |
| PATTERN 5 DATA | 0 0 0 0 0 0 0 0 1 1 0 1 1 0 1 1 0 1 1 0 1 1 0 0 0 0 |

Fig. 7

| ITEM | CURRENT MODE |
|---|---|
| 1 AUTO CLEAR TIME | ③5min |
| 2 REGISTER | ①0mm |
| 3 LEAD EDGE BLANK | ③2mm |
| 4 TONER SUPPLY | ②MEDIUM |
| 5 FIXING TEMPERATURE | ②180°C |
| 6 COUNT | ①UP-COUNT |
| 7 | |
| 8 | |
| 9 | |
| 10 | |

38B

| | |
|---|---|
| FULL ERASE DATA | 1 1 1 1 1 1 1 1 1 1 1 1 1 1 1 1 1 1 1 1 1 1 1 1 1 1 1 1 1 1 1 1 |
| BASIC ERASE DATA | 1 1 1 1 1 1 1 1 0 0 0 0 0 0 0 0 0 0 0 0 0 0 0 0 0 0 0 0 0 0 0 0 |
| PATTERN 1 DATA | 0 0 0 0 0 0 0 0 1 1 1 1 0 0 0 0 0 0 0 0 0 0 0 0 0 0 0 0 0 0 0 0 |
| PATTERN 2 DATA | 0 0 0 0 0 0 0 0 0 0 0 0 1 1 1 1 0 0 0 0 0 0 0 0 0 0 0 0 0 0 0 0 |
| PATTERN 3 DATA | 0 0 0 0 0 0 0 0 0 0 0 0 0 0 0 0 1 1 1 1 0 0 0 0 0 0 0 0 0 0 0 0 |
| PATTERN 4 DATA | 0 0 0 0 0 0 0 0 0 0 0 0 0 0 0 0 0 0 0 0 1 1 1 1 0 0 0 0 0 0 0 0 |
| PATTERN 5 DATA | 0 0 0 0 0 0 0 0 0 0 0 0 0 0 0 0 0 0 0 0 0 0 0 0 1 1 1 1 0 0 0 0 |

COPY INFORMATION OUTPUT DEVICE FOR A COPIER

BACKGROUND OF THE INVENTION

The present invention relates to a copy information output device for a copier of the type managing a number of modes by use of a nonvolatile memory or the like.

It has been customary to provide a copier with a number of dip switches which are operable to select particular operation modes of the copier, e.g. buzzer on and off modes and copy up-count and copy down-count modes. A current trend in the copier art, however, is toward the use of a nonvolatile memory such as a nonvolatile RAM (random access memory), in place of the dip switches, i.e., replacing ONs and OFFs of dip switches with ONEs and ZEROS of the bits of a nonvolatile memory by hardware. Such a trend owes a great deal to the cut-down of cost of nonvolatile memories recently realized.

While the dip switch scheme stated above allows one to see all the modes currently set up at a galance, the nonvolatile RAM scheme fails to do so and, therefore, forces one to check the modes taking a substantial period of time. For example, to see the current modes, one has to select a test mode, then manipulate numeral keys to enter a particular number which is assigned to a desired mode so as to cause a symbol and numerals to appear on a display, and then compare the symbol and numerals with a code table. To check another item, he or she has to repeat the above sequence of steps beginning with the manipulation of the numeral keys. Further, when the modes in which a copier is set are to be confirmed and compiled as data, as would be desired in the event of maintenance and others of the copier, it is necessary for one to transfer the codes appearing on a display one by one. Especially, the data transferred have to be preserved lest the RAM should fail. In this manner, the prior are nonvolatile memory scheme suffers from a drawback that the mode checking and data preserving work is troublesome and time-consuming.

SUMMARY OF THE INVENTION

It is, therefore, an object of the present invention to provide a copy information output device for a copier of the type managing a number of modes by use of a nonvolatile memory which allows one to see all the modes currently selected at a time.

It is another object of the present invention to provide a generally improved copy information output device for a copier of the type managing a number of modes by use of a nonvolatile memory.

In accordance with the present invention, there is provided a copy information output device for a copier, which includes a photoconductive element, using a chart sheet which is treatable as a recording paper sheet and printed with data and items associated with operation modes and information applicable to the copier. The device comprises a memory for storing the modes and information, a data inputting unit for setting the modes and information, and a charge erasing unit for erasing a charge in any position on the photoconductive element based on the data associated with the modes and information which are stored in the memory. The charge erasing unit erases the charge in those positions which are coincident with the modes and information which are stored in the memory while leaving the charge in the other positions which are not coincident with the modes and information, whereby solid images are produced on the photoconductive element and, then, transferred to the chart sheet.

In accordance with the present ivention, there is also provided a copy information output device for a copier, which includes a photoconductive element, using a chart sheet which is treatable as a recording paper sheet and printed with data and items associated with operation modes and information applicable to the copier. The device comprises a memory for storing the modes and information, a data inputting unit for setting the modes and information, and a charge erasing unit for erasing a charge in any position on the photoconductive element based on the data associated with the modes and information which are stored in the memory. The charge erasing unit erases the charge in, in a latent image which is associated with the chart sheet, those portions which do not coincide with the modes and information, the other portions of the latent image which are not erased being developed and transferred to a paper sheet.

BRIEF DESCRIPTION OF THE DRAWINGS

The above and other objects, features and advantages of the present invention will become more apparent from the following detailed description taken with the accompanying drawings in which:

FIG. 3 is a view of a chart sheet applicable to the present invention;

FIG. 7 is a diagram showing the chart sheet in which modes other than those currently set are smeared out;

DESCRIPTION OF THE PREFERRED EMBODIMENT

Figure 1:
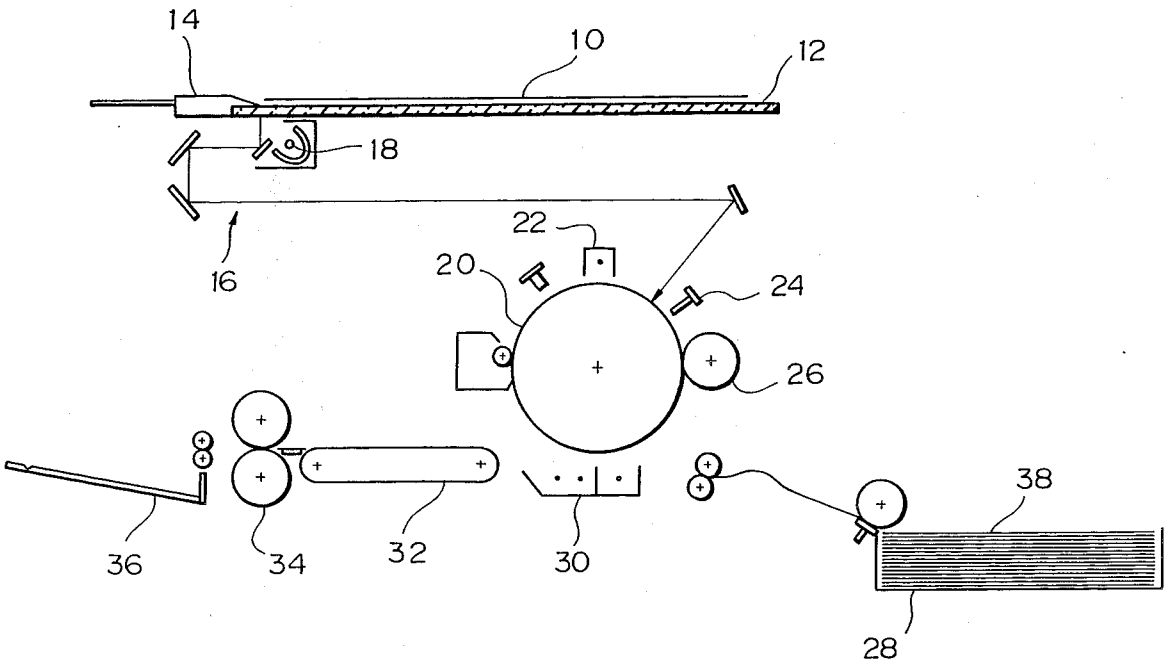
FIG. 1 is a schematic diagram showing an imaging section of a copier.
Figure 2:
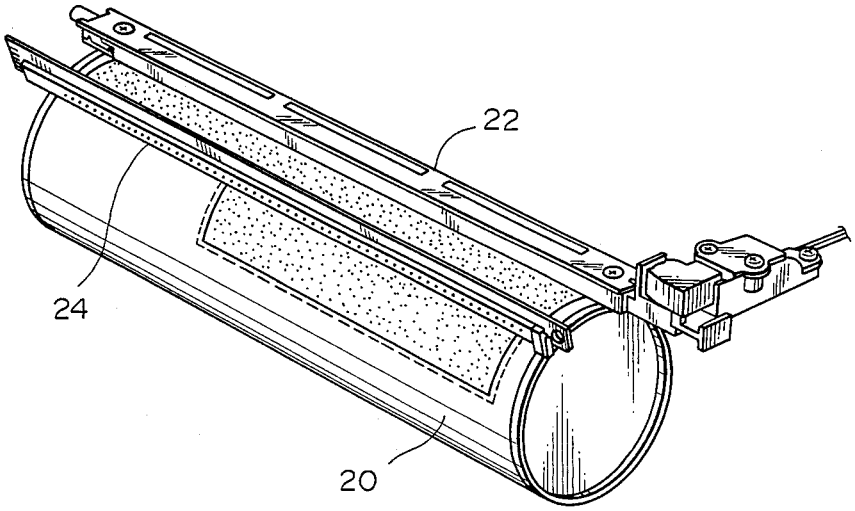
FIG. 2 is a perspective external view of a photoconductive element of the copier and elements associated therewith.

Referring to FIG. 1 of the drawings, an imaging section of a copier to which the present invention is applicable is shown. As shown, an original document 10 is laid on a glass platen 12 and abutted against a document scale 14 which defines a reference position. When a print switch, not shown, is pressed, optics 16 is started to move rightward as viewed in the figure with a lamp 18 thereof turned on. Although a charger 22 continuously deposites a charge on a photoconductive drum 20 while the optics 16 is moved as stated above, a latent image associated with a needless portion which precedes the position where the document 10 is laid does not become visible even when developed at a developing station 26. This is because an eraser 24 located downstream of the optical path and upstream of the developing station 26 is turned on to erase the charge of that latent image. As the optics 16 begins to scan the document 10, the eraser 24 is forcibly turned off with a delay which corresponds to the distance between the optical path and the erasing station and, therefore, prevented from forcibly erasing the charge on the drum 20. As a result, a charge pattern associated with the document 10 is left on the drum 20 to form a latent image. When developed at the developing station 26, this latent image becomes a visible image. In FIG. 1, the reference numerals 28, 30, 32, 34 and 36 designate a sheet cassette, a transfer charger, a belt a fixing roller, and a tray for receiving copies. The drum 20, charger 22 and eraser 24 are shown in an external view in FIG. 2.

Referring to FIG. 3, there is shown a chart sheet, or check sheet, 38 which is applicable to the present invention. Naturally, in an ordinary copy mode, the chart sheet 38 serves as a sheet for reproducing a document image as usual. When the copier is conditioned for a special mode in accordance with the present invention (hereinafter referred to as a check mode), the copier is ready to execute a check mode routine.

The operation of the copier in a check mode which is representative of an embodiment of the present invention is as follows.

Figure 4:
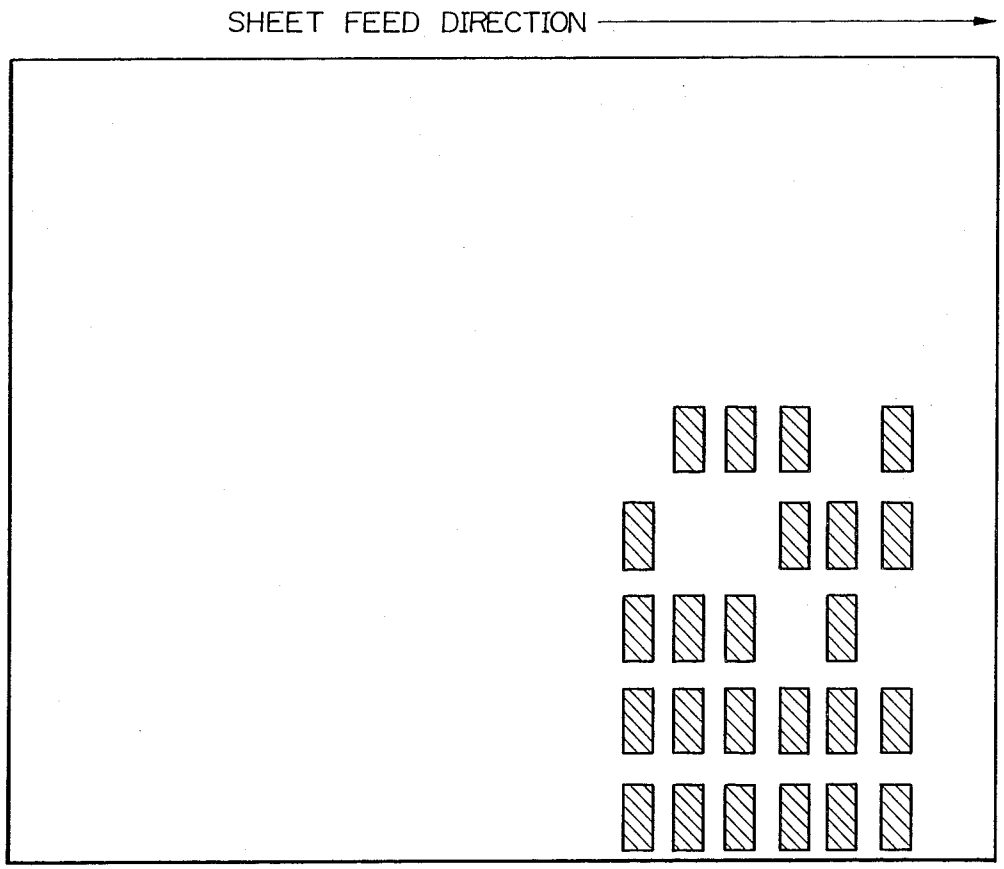
FIG. 4 is a view representative of exemplary areas in which an eraser is turned on to erase needless modes printed on the chart sheet in accordance with one embodiment of the present invention.

First, the chart sheet or check sheet 38 which is implemented with a recording sheet is loaded in the paper cassette 28. When the print switch is turned on, the copier performs charging, erasing, developing and transferring steps but not an exposing step, different from an ordinary copying sequence. Due to the absence of the exposing step, it is possible to form on the drum 20 black solid images in any desired pattern by the charging and erasing steps. Hence, needless ones of the images on the chart sheet 38 can be smeared out by those solid images. FIG. 4 shows a copy 38A which is the chart sheet produced by the above process.

Generally, a copier is furnished with a number of modes which may be selected and/or modified by a serviceman or a salesman based on its conditions or to the user's taste. The various items printed on the chart sheet 38 as shown in FIG. 3 are a part of those selectable modes. For example, the first item "AUTO CLEAR TIME" implies a period of time in which various modes of a copier are automatically restored to their standard modes when the copier is left unused with its power switch turned on, as well known in the art. The standard modes may be a 100% magnification mode, a single copy mode, an automatic density adjustment mode, etc. Specifically, when 1 minute is selected in AUTO CLEAR TIME, the standard modes are set up upon the lapse of 1 minute after the end of a copy operation. In the example shown in FIG. 3, one may select any of 1 minute, 3 minutes, 5 minutes, and infinity which cancels the automatic clear mode.

In parallel with the cost reduction of semiconductors recently achieved, a traditional dip switch approach adapted for the selection of such various modes is increasingly replaced with a nonvolatile memory approach, as stated earlier. With a nonvolatile memory, one may write various mode conditions by using numeral keys which are provided on an operation board and operable to enter a desired number of copies. For example, the automatic clear time of 1 minute may be set by entering "1" through the associated numeral key; data "01H" is written in one byte of the memory. Likewise, the other automatic clear times of three minutes, five minutes and infinity are written in the memory as "02H," "03H," and "04H," respectively. The second item "REGISTER" is representative of a deviation between an image position and a paper position and includes 0 millimeter, −2 millimeters, −4 millimeters, 2 millimeters, and 4 milimeters. These data, too, are written in one byte of the memory as data 01H to 05H. The same applies to the other three items also.

Hereinafter will be described how the segments of the eraser 24 are selectively turned on depending upon the data stored in a nonvolatile memory so as to smear out needless images which are printed on the chart sheet 38. Assuming that "5 minutes" is selected in the item 1 of FIG. 3, "0 millimeter" in the item 2, "2 millimeters" in the item 3, "medium" in the item 4, "180° C." in the item 5, and "upcount" in the item 6. Then, the segments of the eraser 24 are turned on and off as shown in FIG. 4. In the copy 38A of FIG. 4, the time sequence is assumed to extend in the paper feed direction and shown in a plan to facilitate comparison of the copy 38A with the chart sheet 38 of FIG. 3. As shown in FIG. 4, the eraser 24 is turned off for those portions of the chart sheet 38 in which modes other than those currently selected are printed, and it is turned on for the other portions. Then, the charge on the drum 20 is erased except for those areas which are associated with the needless alphanumeric characters on the chart sheet 38. The areas associated with the needless characters are developed to produce black solid images. In the example shown in FIG. 4, those portions of the eraser 24 which are indicated by hatching are turned off.

Figures 5, 6:
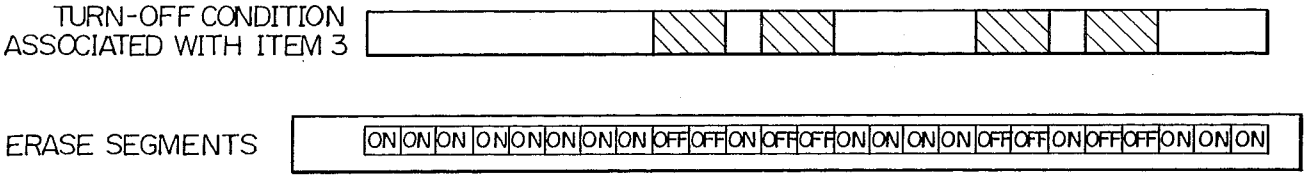
FIG. 5 is a chart showing various erasure patterns.
FIG. 6 is a chart representative of a relationship between one of the erasure patterns shown in FIG. 4 and ON-OFF conditions of an eraser.

The method of producing such an erasure pattern in accordance with this embodiment is as follows. A copier control program includes, as data, erasure patterns which are associated with the modes of the items (in this example, five modes at maximum), as shown in FIG. 5. Specifically, five different kinds of erasure pattern data, i.e., pattern 1 data to pattern 5 data are included in the program and used based on the data stored in the nonvolatile memory. In the item 3 pertaining to the amount of a blank which may be defined at the lead edge of a paper sheet, assume that the mode 3, i.e., 2 millimeters is selected. Then, the segments of the eraser 24 will be selectively turned on and off as shown in FIG. 6 by using the pattern 3 data of FIG. 5. In FIG. 5, those bits in which the eraser 24 is turned off are represented by ONEs while those bits in which it is turned on are represented by ZEROs. As such erase patterns are produced and outputted one after another based on the data stored in the nonvolatile memory and timed to the rotation of the drum 20, a copy 38B shown in FIG. 7 is produced.

Figure 8A:
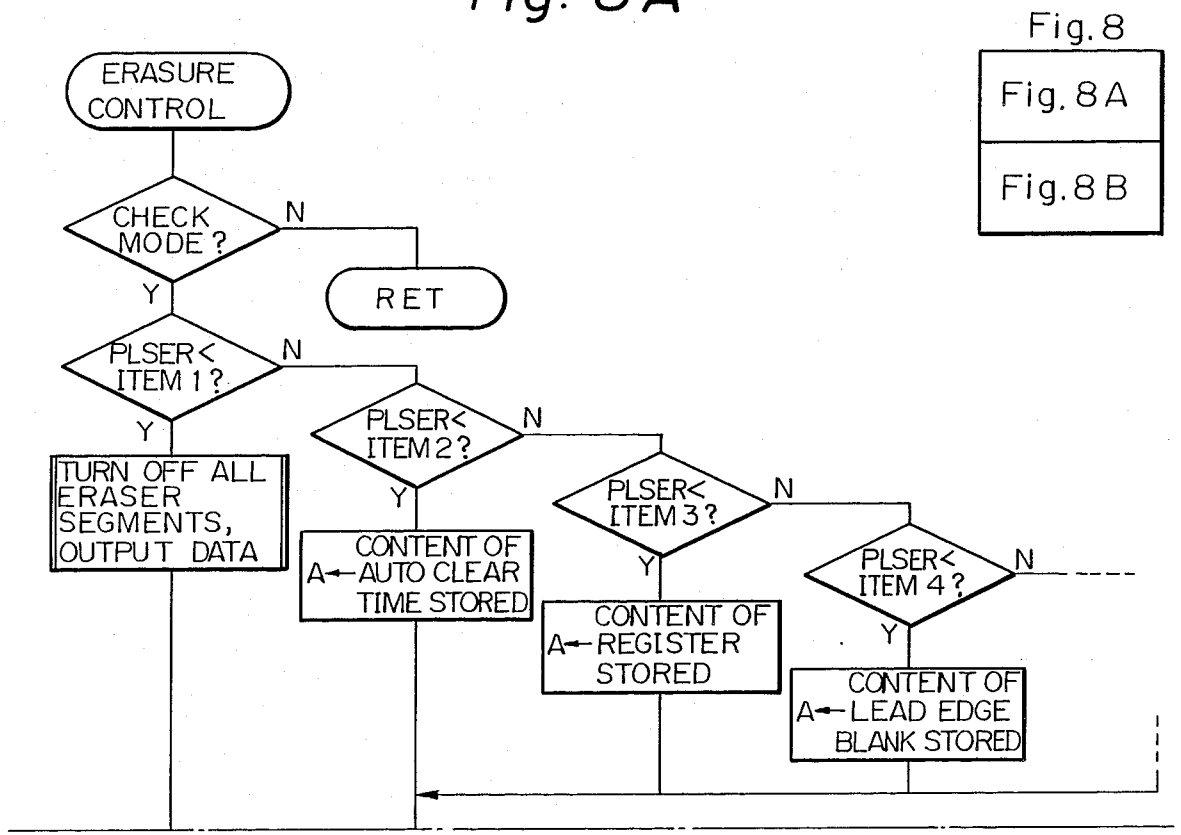
FIGS. 8A and 8b are a flowchart demonstrating an erasure control program.
Figure 8B:
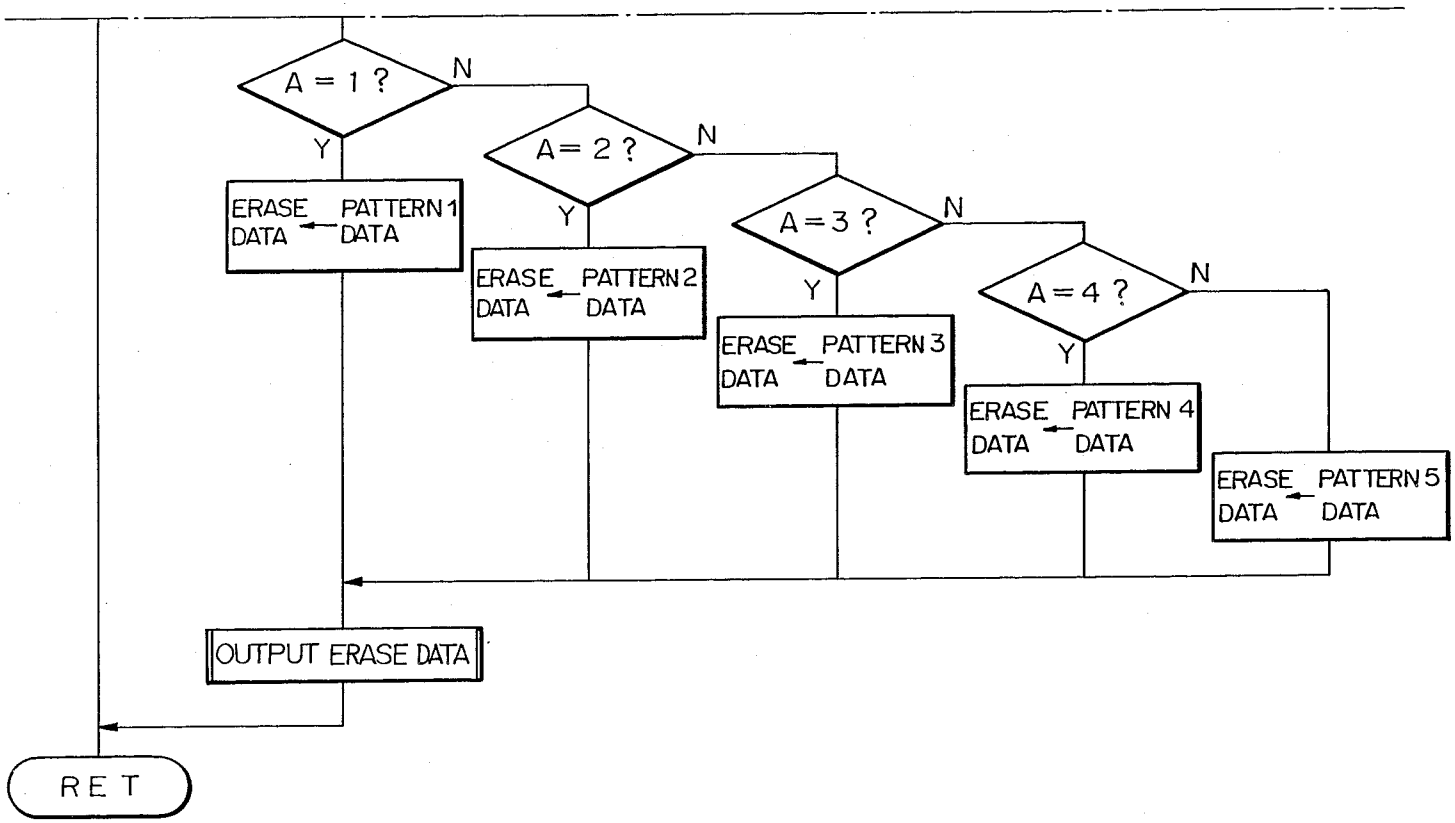

Referring to FIG. 8, an erasure control program in accordance with this embodiment is shown. In the figure, PLSER is representative of a counter which starts counting drum clock pulses, which appear in synchronism with the rotation of the drum 20, when a particular position of the drum 20 which can define the lead edge of a paper sheet has moved past the eraser 24. Specifically, the output of the counter PLSER is indicative of which of the latent images individually corresponding to the various items are moving past the eraser 20. The data stored in the nonvolatile memory are read out on the basis of the count of the counter PLSER.

Figure 9:
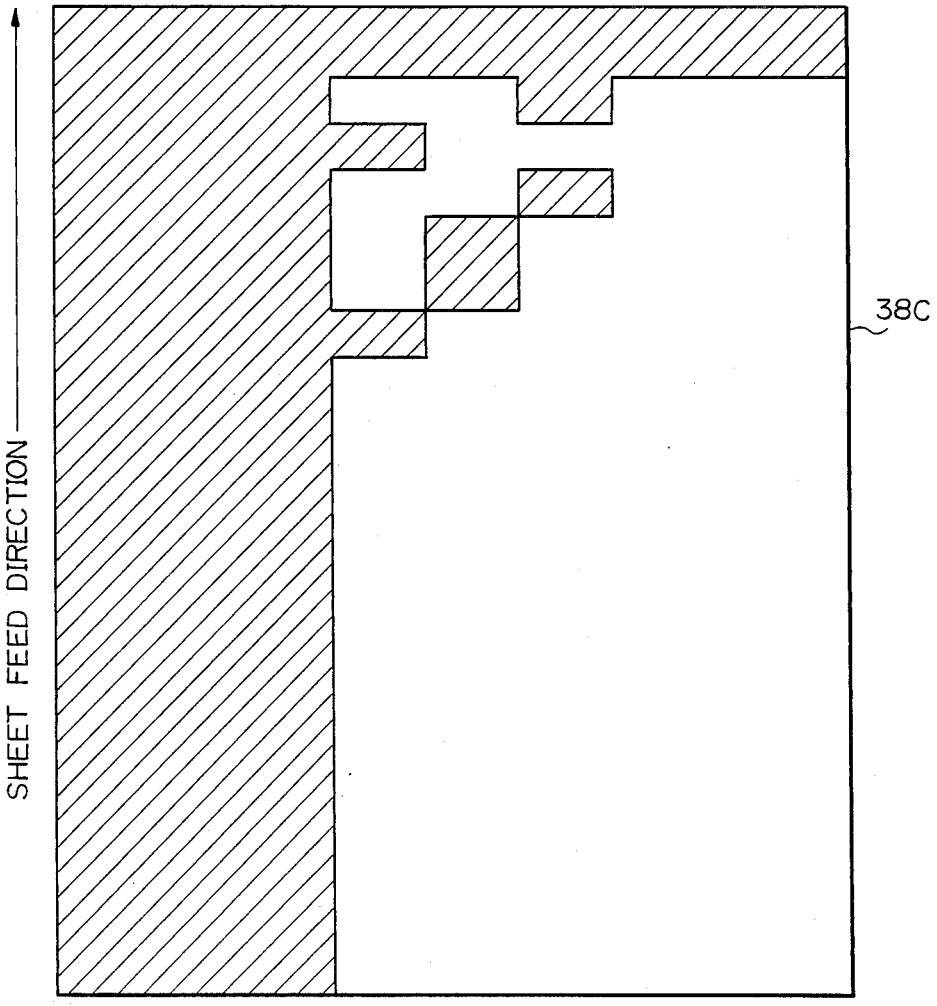
FIG. 9 is a view showing exemplary areas in which all eraser is turned off in accordance with another embodiment of the present invention.

In a check mode in accordance with another embodiment of the present invention, the copier is operated in the following manner. First, the check sheet 38 is loaded in the reference position of the glass platen 12, as previously stated. When the print switch is turned on, the scanner starts moving as in an ordinary copying sequence. After that part of the resulting latent images on the drum 20 which corresponds to the lead edge of the check sheet 38 has moved past the eraser 24, the eraser 24 is not forcibly turned off and, instead, its segments are selectively turned on and off to erase those latent images which are representative of needless images printed on the check sheet 38. FIG. 9 shows a copy 38C which is produced by such a process.

Hereinafter will be described the method in accordance with this embodiment for selectively turning on and off the segments of the eraser 24 to smear out only the needless images which are printed on the check sheet 38. In FIG. 9, as in FIG. 4, "5 minutes" are selected in the item 1, "0 millimeter" in the item 2, "2 millimeter" in the item 3, "medium" in the item 4, "180° C." in the item 5, "upcount" in the item 6. To facilitate comparison of FIG. 9 with FIG. 3, the time sequence is shown as extending in the sheet feed direction and in a plan. As shown in FIG. 9, the eraser 24 is turned off for those portions of the check sheet 38 which correspond to ITEM, CURRENT MODE, and the current modes which are selected in the respective items, and it is turned on for the other portions. Consequently, the charge on the drum 20 is erased except for those portions which are representative of necessary images on the check sheet 38. In FIG. 9, the eraser 24 is turned off as indicated by hatching.

Figures 10, 11:
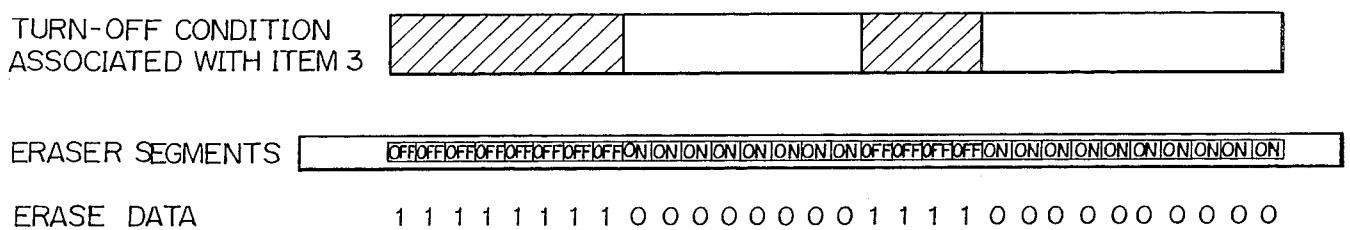
FIG. 10 is a chart showing erasure patterns.
FIG. 11 is a chart representative of a relationship between one of the erasure patterns of FIG. 10 and ON-OFF conditions of the eraser together with erase data.

The method of producing such an erasure pattern in accordance with this embodiment is as follows. As previously stated, a copier control program includes, as data, erasure patterns which are associated with the modes of the items (in this example, five modes at maximum), as shown in FIG. 10. Specifically, seven different kinds of erase pattern data are included in the program and used as erase line data in matching relation to the data stored in the nonvolatile memory. In the item 3 pertaining to the amount of a black which may be defined at the lead edge of a paper sheet, assume that the mode 3, i.e, 2 millimeters is selected. The data shown in FIG. 11 is produced by ANDing the basic erase data and the pattern 3 data as shown in FIG. 10. In FIGS. 10 and 11, those bits where the eraser 24 is turned off are represented by ONEs while those bits where it is turned on are represented by ZEROs. As such erase patterns are produced and outputted one after another based on the contents of the nonvolatile memory and timed to the rotation of the drum 20, a copy 38B shown in FIG. 7 is produced.

Figure 12A:
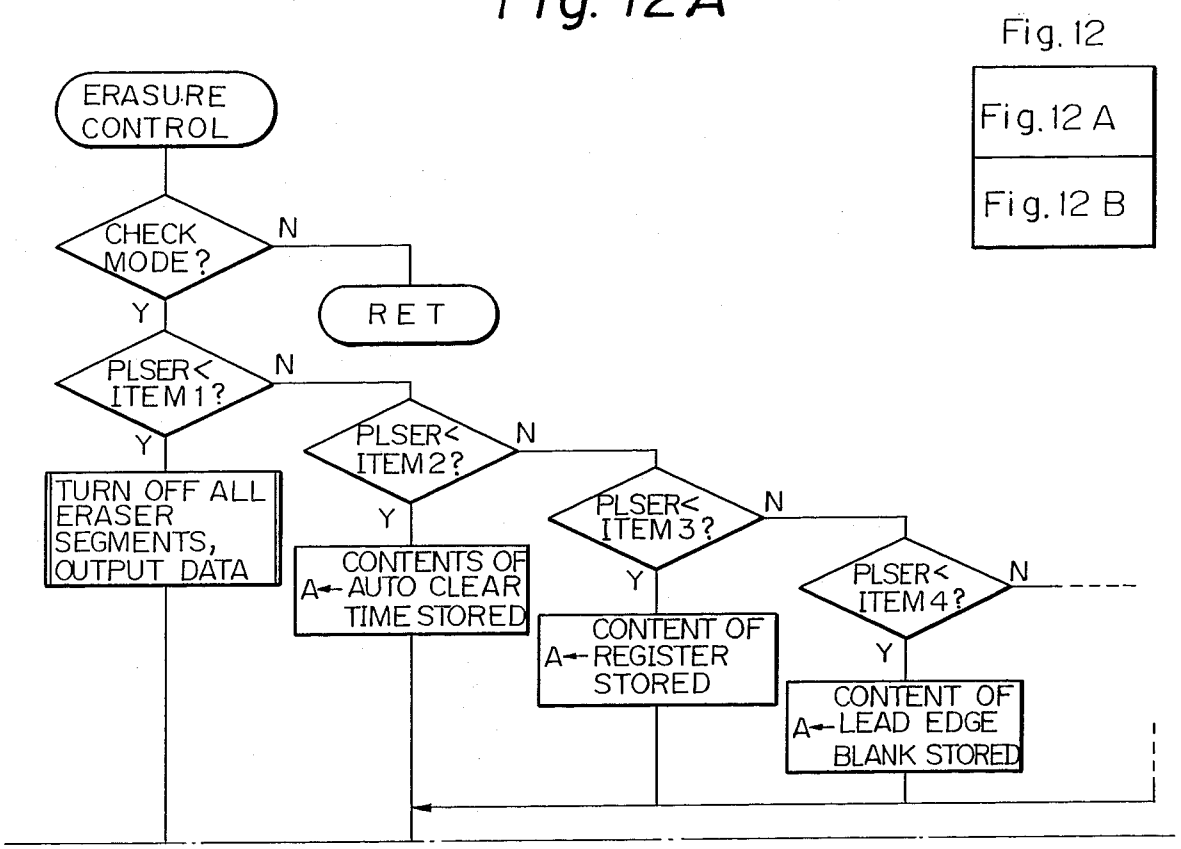
FIGS. 12A and 12B are a flowchart demonstrating an erasure control program.
Figure 12B:
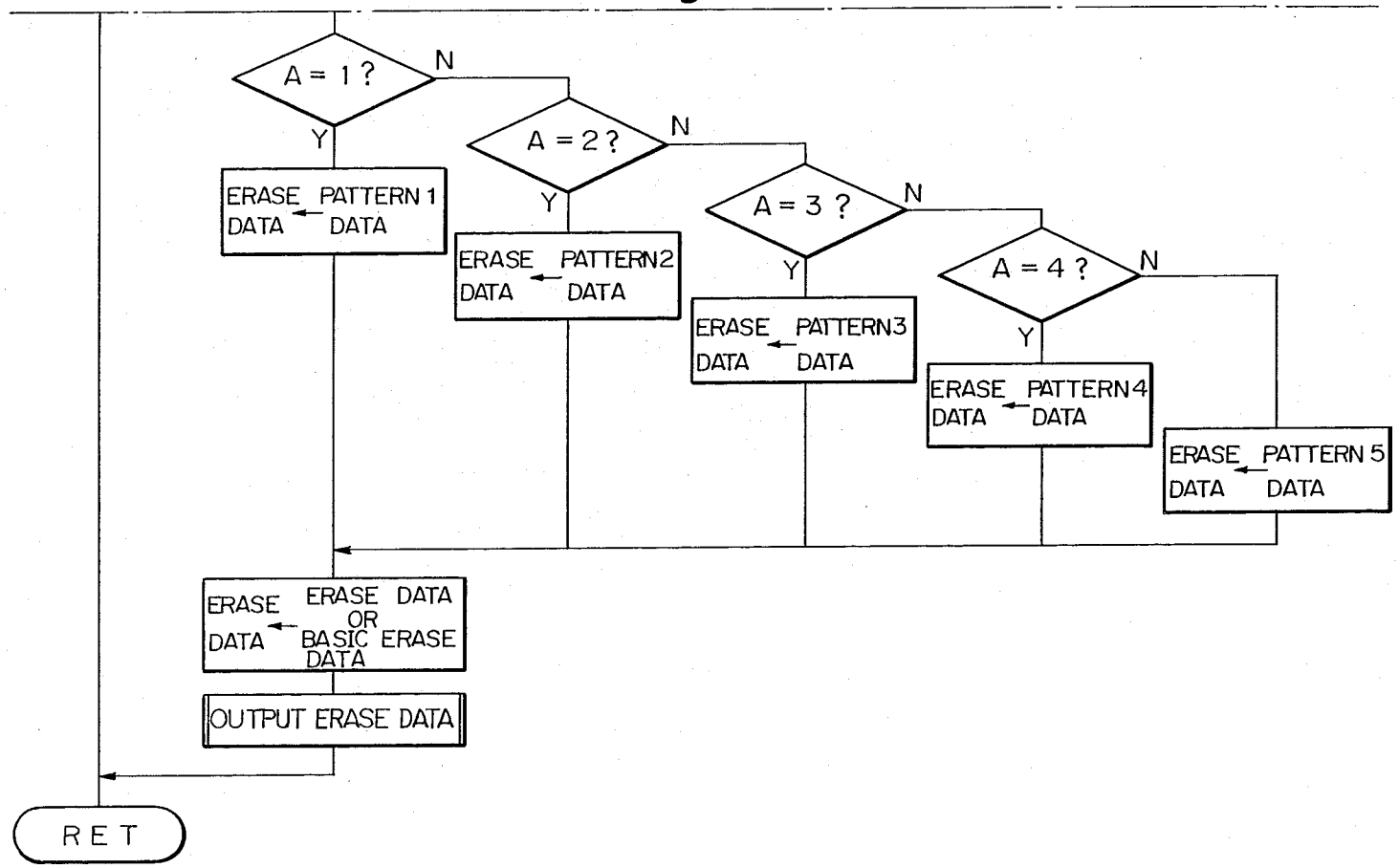

FIG. 12 is a flowchart demonstrating an erasure control program in accordance with this embodiment.

In summary, it will be seen that the present invention provides a copy information output device which allows one to readily see various current modes of a copier at a time by executing a check mode. The modes of the copier are printed out on a paper to provide a history of the copier. Further, the maintenance by a serviceman or a salesman as well as the confirmation by a user is facilitated.

Various modifications will become possible for those skilled in the art after receiving the teachings of the present disclosure without departing from the scope thereof.

What is claimed is:

1. A copy information output device for a copier, which includes a photoconductive element, using a chart sheet which is treatable as a recording paper sheet and printed with data and items associated with operation modes and information applicable to said copier, said device comprising:

memory means for storing said modes and information;

data inputting means for setting said modes and information; and charge erasing means for erasing a charge in any position on said photoconductive element based on said data associated with said modes and information which are stored in said memory means;

said charge erasing means erasing said charge in those positions which are coincident with said modes and information which are stored in said memory means while leaving said charge in the other positions which are not coincident with said modes and information, whereby solid images are produced on said photoconductive element and, then, transferred to said chart sheet.

2. A copy information output device as claimed in claim 1, wherein at least two kinds of operation modes are selectively set for each of said items.

3. A copy information output device as claimed in claim 1, wherein said memory means comprises a nonvolatile RAM.

4. A copy information output device for a copier, which includes a photoconductive element, using a chart sheet which is treatable as a recording paper sheet and printed with data and items associated with operation modes and information applicable to said copier, said device comprising:

memory means for storing said modes and information;

data inputting means for setting said modes and information; and charge erasing means for erasing a charge in any position on said photoconductive element based on said data associated with said modes and information which are stored in said memory means;

said charge erasing means erasing said charge in, in a latent image which is associated with said chart sheet, those portions which do not coincide with said modes and information, the other portions of said latent image which are not erased being developed and transferred to a paper sheet.

5. A copy information output device as claimed in claim 4, wherein at least two kinds of operation modes are selectively set for each of said items.

6. A copy information output device as claimed in claim 4, wherein said memory means comprises a nonvolatile RAM.

* * * * *

UNITED STATES PATENT AND TRADEMARK OFFICE

CERTIFICATE OF CORRECTION

PATENT NO. : 4,851,878

DATED : July 25, 1989

INVENTOR(S) : Hiroyasu SUMIDA

It is certified that error appears in the above-identified patent and that said Letters Patent is hereby corrected as shown below:

On the Title Page, the number of drawings is incorrect, it should read as follows:

--12--

Signed and Sealed this

Fifth Day of June, 1990

*Attest:*

HARRY F. MANBECK, JR.

*Attesting Officer*

*Commissioner of Patents and Trademarks*